US005642701A

United States Patent [19]

Oswald et al.

[11] Patent Number: 5,642,701

[45] Date of Patent: Jul. 1, 1997

[54] ENGINE CYLINDER HEAD ASSEMBLY HAVING PLANAR AND CAST COMPONENTS

[75] Inventors: Denis A. Oswald, Hartford; Mark W. Emmer, Pewaukee; Daniel W. Edmonds; Robert S. Johnson, both of Milwaukee, all of Wis.

[73] Assignee: Briggs & Stratton Corporation, Wauwatosa, Wis.

[21] Appl. No.: 589,798

[22] Filed: Jan. 22, 1996

[51] Int. Cl.[6] ..... F01M 9/10

[52] U.S. Cl. ..... 123/193.5; 123/193.3

[58] Field of Search ..... 123/193.5, 193.3, 123/90.39

[56] References Cited

U.S. PATENT DOCUMENTS

| | | | |
|---|---|---|---|
| 1,368,522 | 2/1921 | Newcomb | 123/193.3 |
| 1,402,695 | 1/1922 | Wall . | |
| 2,337,577 | 12/1943 | Taylor . | |
| 2,492,582 | 12/1949 | Klotsch et al. . | |
| 2,975,778 | 3/1961 | Wilcox . | |
| 3,429,303 | 2/1969 | Roberts | 123/193.5 |
| 3,949,715 | 4/1976 | Falx et al. | 123/193.5 |
| 4,337,736 | 7/1982 | Rasch et al. . | |
| 4,513,702 | 4/1985 | Koga et al. | 123/193.5 |
| 4,570,484 | 2/1986 | Hayashi . | |
| 4,694,646 | 9/1987 | Holmstrom . | |
| 5,058,542 | 10/1991 | Grayson et al. | 123/193.5 |
| 5,235,942 | 8/1993 | Olmr . | |

OTHER PUBLICATIONS

Tecumseh Two Piece OHV cylinder head, sold at least as early as Nov. 14, 1994, photos and sketch.

*Primary Examiner*—Marguerite McMahon
*Attorney, Agent, or Firm*—Michael, Best & Friedrich

[57] ABSTRACT

The cylinder head assembly includes a cast member, and a substantially planar member that is affixed to an upper end of the cast member. The substantially planar member includes apertures to anchor the intake and exhaust rocker studs, apertures that receive the intake and exhaust valve, and apertures that receive the push rod guides. The substantially planar member also has spring locators for the intake and exhaust valve return springs. The cast member is affixed to the engine cylinder, and includes cast intake and exhaust manifolds, bosses for receiving the intake and exhaust valves, a cast pocket for receiving the intake and exhaust push rods, and air cooling fins. A head cover is disposed on an opposite side of the planar member. The invention eliminates the need for two cast components.

27 Claims, 2 Drawing Sheets

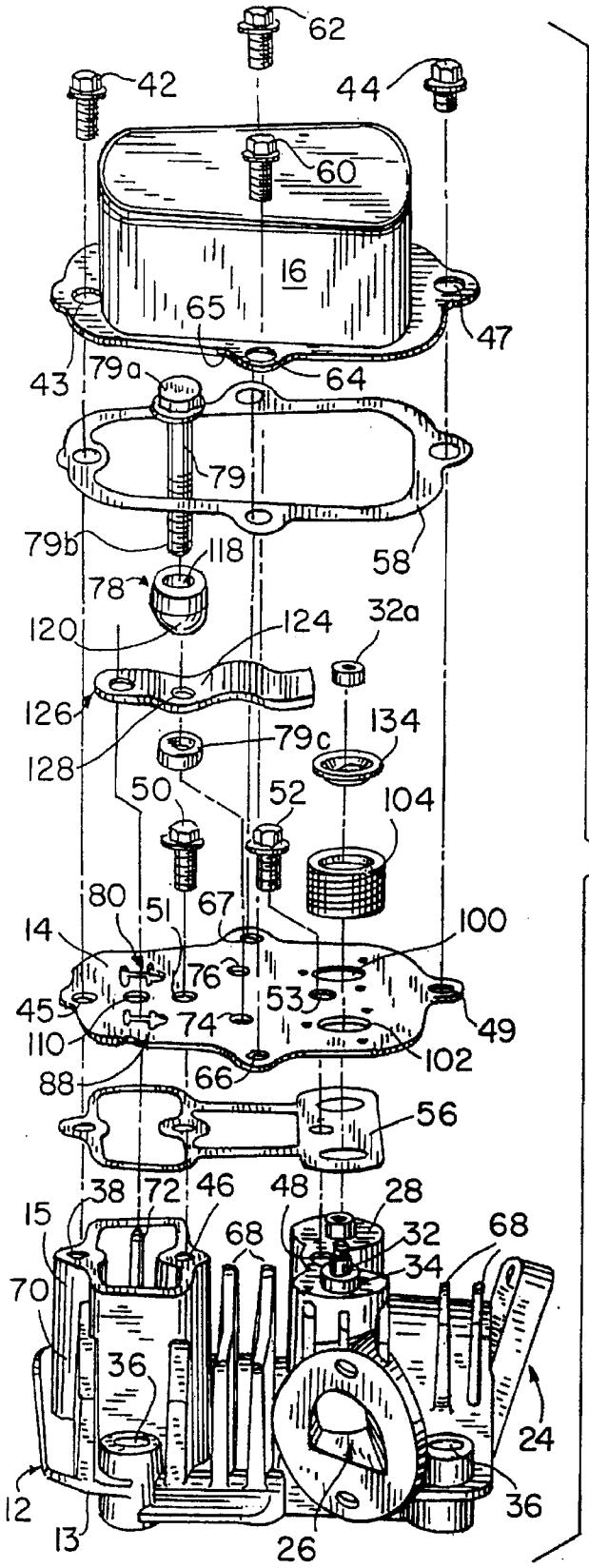
FIG. 2
FIG. 1
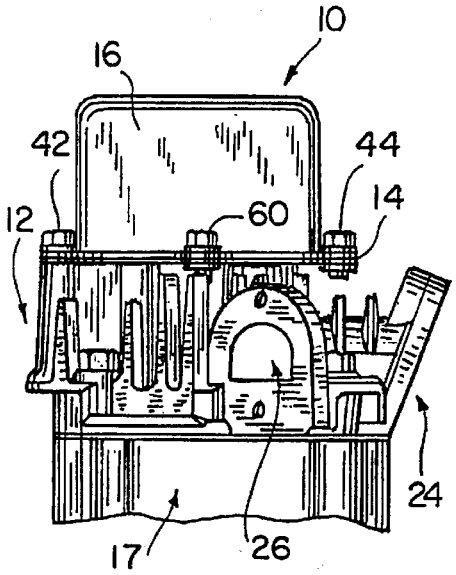
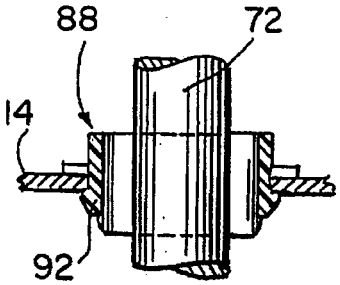
FIG. 5

ENGINE CYLINDER HEAD ASSEMBLY HAVING PLANAR AND CAST COMPONENTS

BACKGROUND OF THE INVENTION

This invention relates to cylinder head assemblies for internal combustion engines. More particularly, this invention relates to engine cylinder head assemblies having a cast component and a non-cast component.

A typical prior art engine cylinder head assembly includes two die cast components or elements. Such cylinder head assemblies are expensive to manufacture since two castings, and the tooling for two different castings, are required.

To overcome the high cost of cylinder heads having two cast components, it has been proposed to manufacture an integral cylinder head comprised of a single casting. However, the casting, and the tooling for such a casting, are very complex and expensive to manufacture.

Typical prior art overhead valve (OHV) cylinder heads have two valve train-rocker assemblies for opening and closing the intake and the exhaust valves. In typical prior art cylinder heads, a boss must be formed in a casting to receive the stud bolt used to hold each of the two rocker arms in place. After the boss is formed, it must be drilled or otherwise machined, and the rocker stud must be threaded into the machined hole. These extra steps further increase the cost of the cylinder head assembly.

Also, in typical prior art cylinder head assemblies, it is necessary to provide guides for the push rods which operate the intake and exhaust valves. The push rod guides are typically incorporated into a separate plate that is affixed to the head by rocker studs, or by other means. The use of a separate plate increases the cost of the head assembly.

SUMMARY OF THE INVENTION

A cylinder head assembly for an internal combustion engine is disclosed that comprises a cast member, a substantially planar member disposed adjacent to an upper end of the cast member, and a head cover disposed on the opposite side of the planar member from the cast member.

The cast member has a first means, such as one or two cast bosses, for receiving an intake valve and an exhaust valve. The cast member also includes a second means, such as a cast pocket, for receiving an intake valve push rod and an exhaust valve push rod. The cast member also preferably includes a cast intake manifold, a cast exhaust manifold, and mounting bosses for mounting the cast member to the engine cylinder.

At least one cast air cooling fin projects from the upper end of the cast member, and may be disposed between the first receiving means and the second receiving means.

The substantially planar member—which may be stamped or injection molded—is affixed to the upper end of the cast member, and includes a third means for receiving the intake valve and the exhaust valve. The third means preferably comprises a pair of spaced apertures. The substantially planar member also includes a fourth means for receiving the intake valve push rod and the exhaust valve push rod; the fourth means may comprise third and fourth spaced apertures. A first guide is snapped into the third aperture for guiding the intake valve push rod. Similarly, a second guide is snapped into the fourth aperture for guiding the exhaust valve push rod. The planar member may also include spring locators for the intake valve return spring and for the exhaust valve return spring, and means for anchoring the two rocker arm studs that hold the rocker arms in place. The anchoring means preferably includes two spaced apertures in the planar member, each of the apertures receiving a rocker stud.

It is a feature and advantage of the present invention to lower the cost of an engine cylinder head assembly.

It is another feature and advantage of the present invention to provide a cylinder head assembly having a single casting which is still easy to manufacture.

These and other features and advantages of the present invention would be apparent to those skilled in the art from the following description of the preferred embodiment, and the drawings, in which:

BRIEF DESCRIPTION OF THE DRAWINGS

FIG. 1 is a side view of a cylinder head assembly according to the present invention.

FIG. 2 is an exploded side view of the cylinder head assembly, with only a single valve train being depicted.

FIG. 5 is a side view of an exhaust valve push rod received in an exhaust push rod snap in guide, taken along line 5—5 of FIG. 4.

DETAILED DESCRIPTION OF THE PREFERRED EMBODIMENT

Figure 3:
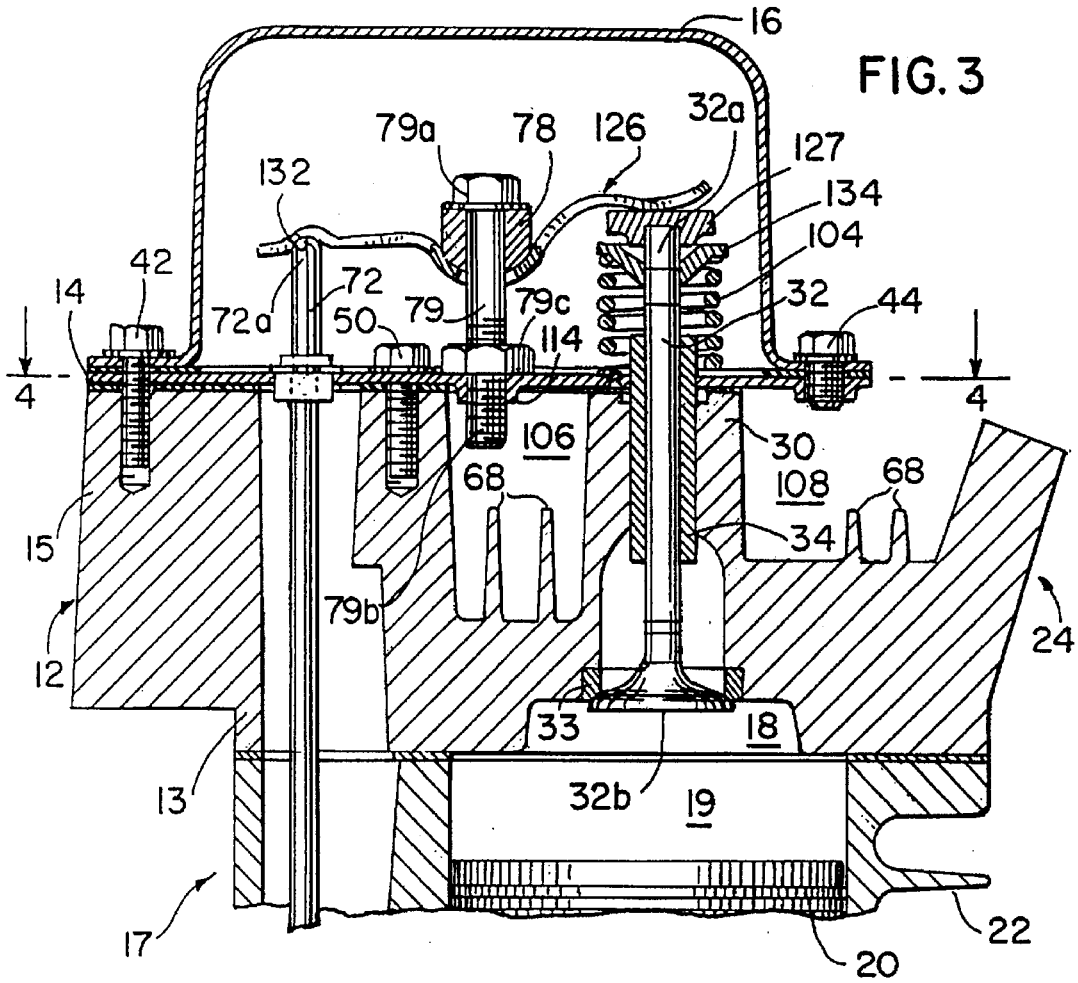
FIG. 3 is a side view of the cylinder head assembly according to the present invention, shown in partial section.

FIGS. 1 through 3 depict the complete cylinder head assembly according to the present invention. In FIGS. 1 through 3, cylinder head assembly 10 includes a die cast element 12, a stamped or injection molded substantially planar member 14, and a stamped or injection molded head cover 16. As shown in FIG. 3, die cast element 12 includes a lower end 13 that is affixed to an engine cylinder 17. Cylinder 17 includes a cylinder bore 19, a reciprocable piston 20, and at least one air cooling fin 22.

As best shown in FIGS. 1 and 2, cast element 12 also includes an integral, cast intake manifold 24 that is in fluid flow communication with combustion chamber 18 (FIG. 3). Cast element 12 also includes an integral, cast exhaust manifold 26 that is also in fluid flow communication with combustion chamber 18.

As best shown in FIG. 2, cast member 12 includes a cast boss 28 that projects from lower end 13 of cast member 12, and that receives an intake valve, which is not shown to reduce the complexity of FIGS. 2 and 3. Cast element 12 may also receive an optional intake valve guide that is press-fit into cast element 12. Also projecting from lower end 13 of cast member 12 is a boss 30 that receives an exhaust valve 32, which is best shown in FIG. 3. Exhaust valve 32 is substantially identical to the intake valve. Exhaust valve 32 is guided by an exhaust valve guide 34 (FIG. 3), which is press-fit into boss 30. Exhaust valve guide 34, as well as the intake valve guide, preferably extend above planar member 14. See FIGS. 2 and 3.

Cast member 12 also includes a plurality of mounting bosses. Mounting bosses 36 (FIGS. 1 and 2) are used mount cast member 12 to engine cylinder 17. In addition, cast member 12 has a mounting boss 38 which receives a bolt 42 to mount head cover 16 and planar member 14 to cast member 12. Bolt 42 is received in aperture 43 of head cover 16 and aperture 45 of planar member 14.

Cast member 12 also includes mounting bosses 46 and 48 which, along with bolts 50 and 52, mount planar member 14 to cast member 12. Bolt 50 is received in aperture 51 of planar member 14, and bolt 52 is received in aperture 53 of planar member 14. A gasket 56 is provided between cast member 12 and planar member 14. Similarly, a gasket 58 is provided between planar member 14 and head cover 16. Head cover 16 is also mounted to planar member 14 via bolts 44, 60 and 62, which bolts are received in apertures 47, 64 and 65 respectively of head cover 16, and apertures 49, 66 and 67 respectively of planar member 14.

As best shown in FIGS. 2 and 3, cast member 12 also includes a plurality of air cooling fins 68 which project upwardly from lower end 13 of cast member 12. At least some of cooling fins 68 are disposed between bosses 28 and 30 on the one hand and boss 70 on the other hand, these cooling fins being substantially parallel to a line 71 joining the longitudinal axes of the intake and exhaust valves (see FIG. 4). Only exhaust push rod 72 is depicted in FIGS. 2 and 3 to simplify the Figures, it being understood that the intake push rod is substantially identical to exhaust valve push rod 72. The intake and exhaust push rods may be disposed in a single cast pocket 70, or may be disposed in separate pockets.

Although the preferred embodiment of the present invention uses a die cast member 12, it will be apparent to those skilled in the art that other methods (e.g., sand casting) may be used to form member 12 without departing from the present invention.

Another feature of the present invention is that production of the cast elements is increased since only one cast element is used, and since each cast element only requires two retractable slides during the casting process, one for each of the intake and exhaust manifolds. As a result, more die cast components can be simultaneously made since space is not required for inserting and extracting slides in more than two directions.

Figure 4:
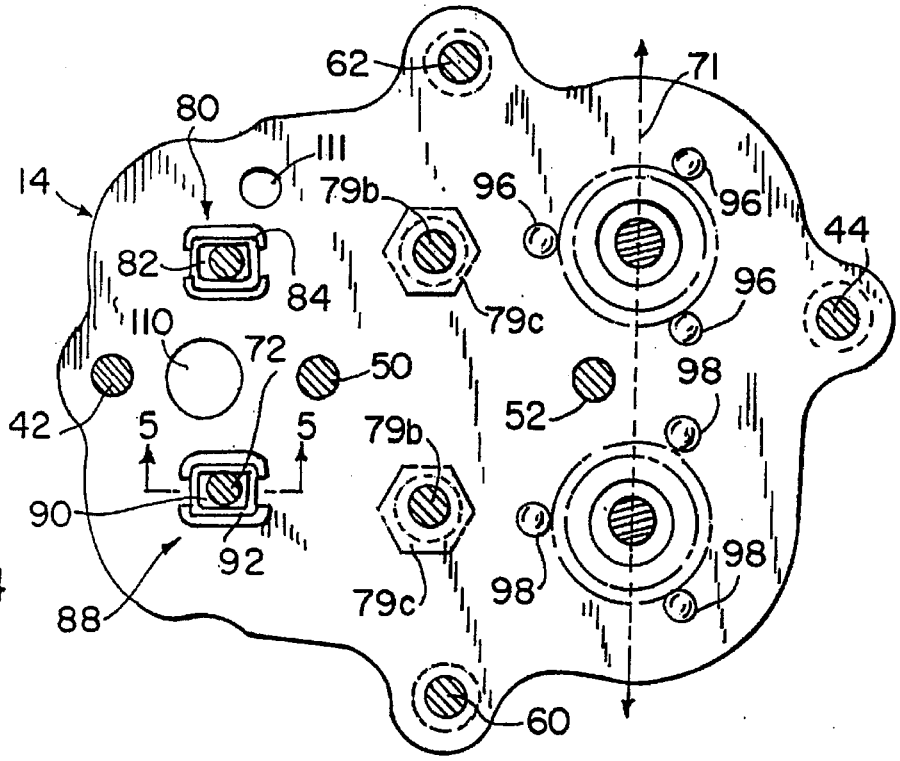
FIG. 4 is a top view of the substantially planar member according to the present invention, taken along line 4—4 of FIG. 3.

Planar member 14 is best understood in connection with FIGS. 2 and 4. With reference to FIGS. 2 and 4, planar member 14 is preferably formed by stamping, and consists of a metal plate. Of course, other methods may be used to form planar member 14 such as injection molding, although stamping is preferred because it is the least expensive.

In FIGS. 2 and 4, planar member 14 is affixed to an upper end 15 of cast member 12 by bolts 42, 50 and 52 as discussed above. Planar member 14 also includes spaced apertures 74 and 76, which are used to anchor a pair of rocker studs 79 (only one of which is shown) of the two rocker arm assemblies. Note that rocker studs 79 are anchored only in apertures 74 and 76, and are not received in mounting bosses of cast member 12, as was typically done in the prior art. This arrangement simplifies the manufacture and the machining of cast member 12, since additional mounting bosses in the cast member are not required, nor the corresponding drilling of the mounting bosses. The rocker assembly is discussed in greater detail below.

Another feature of planar member 14 is that the planar member includes the push rod guides for the intake and exhaust push rods. In typical prior art cylinder heads, the push rod guides are formed in a separate plate that is affixed to the entirely cast cylinder head. In the present invention, a planar member receives the intake and exhaust valves and also has the intake and exhaust push rod guides interconnected therewith.

In the present invention, exhaust push rod guide 80 includes an aperture 82 (FIG. 4) and a snap in guide member 84 which keeps the push rod in alignment. Similarly, intake push rod guide 88 includes an aperture 90, and a snap in guide member 92. Guide member 92 is substantially the same as guide member 84. Guide member 92 is best shown in FIG. 5.

As an alternative to snap in guide members 84 and 92, the metal on two opposed sides of apertures 82 and 90 may be rolled to form integral guide members.

Again referring to FIGS. 2 and 4, planar member 14 preferably includes a means for locating the return spring for the intake valve, and a means for locating or positioning the return spring for the exhaust valve. As best shown in FIG. 4, the intake valve spring locator comprises three raised nibs 96 which project from planar member 14. Similarly, the locator for the exhaust valve return spring consists of three raised nibs 98 which project from the surface of planar member 14. Nibs 96 are preferably disposed in a symmetrical pattern around aperture 100 (FIG. 2) which receives the intake valve. Aperture 100 may also receive a portion of an intake valve guide. Similarly, nibs 98 are disposed in a symmetrical pattern around aperture 102 which receives exhaust valve 32. As depicted in FIG. 3, aperture 102 may also receive a portion of exhaust valve guide 34. Of course, the spring locators may consist of a different number of nibs, or the nibs may be arranged in a different pattern. In place of the nibs, other types of projections may be used, as long as the projections engage the return springs 104 (FIGS. 2 and 3) to keep the return springs in proper alignment and in proper position. In some applications, the spring locators may be unnecessary.

As best shown in FIG. 3, air passageways 106 and 108 are formed when planar member 14 is affixed to cast member 12. Air is able to freely flow through passageways 106 and 108 to aid in the cooling of the cylinder head.

Planar element 14 also includes an aperture 110 (FIGS. 2 and 4) that may be used as a lubrication port for providing lubrication to the entire valve train. Aperture 111 in planar member 14 is an oil drain back hole.

FIGS. 2 and 3 depict a preferred rocker assembly that may be used with the present invention. It is understood that other rocker assemblies may be used.

FIGS. 2 and 3 depict a rocker assembly for the exhaust valve. It is understood that the rocker assembly for the intake valve is preferably identical to the rocker assembly for the exhaust valve. In FIGS. 2 and 3, the rocker assembly includes a rocker fulcrum 78 that receives a threaded stud 79. Stud 79 has a tool engaging means, such as a hexagonal head **79*a*. Threaded portion 79*b* of stud 79 is received in aperture 74 of planar element 14 (FIG. 2). A lock nut 79*c* locks the position of stud 79. An extruded hole 114 (FIG. 3) is formed by a rolling method to anchor, align and support threaded portion 79*b* of rocker stud 79**.

Rocker stud 79 is received in an aperture 118 of rocker fulcrum 78. Fulcrum 78 has a curved surface 120 that engages a corresponding curved surface 124 on a stamped rocker arm 126. Surface 120 may be concave or spherical in shape. Stud 79 also passes through an aperture 128 in rocker arm 126, as best shown in FIG. 3.

Rocker arm 126 rests on a valve cap 127 which retains an upper end **32*a* (FIG. 3) of exhaust valve 32. Rocker arm 126 also includes an indentation 132 that receives end 72*a* of exhaust push rod 72, as best shown in FIG. 3. In FIGS. 2 and 3, a return spring 104 is disposed around end 32*a* of exhaust valve 32, is positioned by spring locator 96, and is retained by a spring retainer 134**.

The exhaust valve train-rocker assembly operates in the following manner. A cam follower (not shown) of push rod 72 engages a cam lobe disposed on a cam shaft (not shown). In response, push rod 72 is displaced toward head cover 16, thereby pivoting rocker arm 126 about fulcrum 78. As a result, rocker arm 126 pushes valve end 32*a*, thereby raising valve head 32*b* off of its valve seat 33 to open the valve. As the cam shaft continues to rotate, the upward force on push rod 72 is reduced, and return spring 104 applies a force on rocker arm 126 to pivot the rocker arm. As a result, valve 32 closes when valve head 32*b* is now seated on valve seat 33. The intake valve train-rocker assembly operates in a similar manner.

While a preferred embodiment of the present invention has been shown and described, alternate embodiments will be apparent to those skilled in the art and are within the intended scope of the present invention. Therefore, the invention is to be limited only by the following claims.

We claim:

1. A cylinder head assembly for an internal combustion engine, comprising:

a cast member, including a lower end that is interconnected with an engine cylinder;

an upper end;

first means for receiving an intake valve and an exhaust valve;

second means for receiving an intake valve push rod and an exhaust valve push rod;

a substantially planar member interconnected with the upper end of said cast member, including third means for receiving said intake valve and said exhaust valve; and fourth means for receiving said intake valve push rod and said exhaust valve push rod.

2. The cylinder head assembly of claim 1, further comprising:

a head cover disposed on an opposite side of said substantially planar member from said cast member.

3. The cylinder head assembly of claim 1, wherein said cast member further comprises:

at least one air cooling fin disposed between said first receiving means and said second receiving means.

4. The cylinder head assembly of claim 1, wherein said first receiving means includes an exhaust valve guide.

5. The cylinder head assembly of claim 1, wherein said second receiving means includes:

at least one cast pocket that receives said intake and exhaust push rods.

6. The cylinder head assembly of claim 1, wherein said third receiving means includes:

a first aperture that receives said intake valve; and a second aperture that receives said exhaust valve.

7. The cylinder head assembly of claim 1, wherein said fourth receiving means includes:

a first aperture that receives said intake push rod; and a second aperture that receives said exhaust push rod.

8. The cylinder head assembly of claim 7, wherein said fourth receiving means also includes:

a first guide member disposed in said first aperture; and a second guide member disposed in said second aperture.

9. The cylinder head assembly of claim 1, wherein said substantially planar member comprises a metal plate.

10. The cylinder head assembly of claim 1, wherein said substantially planar member comprises an injection molded part.

11. The cylinder head assembly of claim 1, wherein said first receiving means includes:

a first aperture that receives said intake valve;

a second aperture that receives said exhaust valve;

and wherein said second receiving means includes:

a third aperture that receives said intake valve push rod; and a fourth aperture that receives said exhaust valve push rod.

12. The cylinder head assembly of claim 1, wherein said substantially planar member also includes:

an intake spring locator that positions an intake valve return spring; and an exhaust spring locator that positions an exhaust valve return spring.

13. The cylinder head assembly of claim 1, wherein said substantially planar member also includes:

means for anchoring at least one rocker stud.

14. The cylinder head assembly of claim 13, wherein said anchoring means includes:

an aperture in said substantially planar member that receives said rocker stud.

15. The cylinder head assembly of claim 1, wherein said cast member further comprises:

a cast intake manifold; and a cast exhaust manifold.

16. A cylinder head assembly for an internal combustion engine, comprising:

a first member, including:

a lower end that is interconnected with an engine cylinder;

an upper end;

at least one cast boss that receives an intake valve and an exhaust valve;

at least one cast pocket that receives an intake push rod and an exhaust push rod;

a substantially planar member, interconnected with said upper end of said first member, including:

at least one aperture, aligned with said at least one cast boss, that receives said intake valve and said exhaust valve;

an intake push rod guide, disposed above said at least one cast pocket, that receives said intake push rod; and an exhaust push rod guide, disposed above said at least one cast pocket, that receives said exhaust push rod.

17. The cylinder head assembly of claim 16, further comprising:

a head cover disposed on a side of said planar member that is opposite to said first member.

18. The cylinder head assembly of claim 16, wherein said first member further comprises:

at least one air cooling fin disposed between said boss and said pocket.

19. The cylinder head assembly of claim 16, wherein said first member further comprises:

a cast intake manifold; and a cast exhaust manifold.

20. The cylinder head assembly of claim 16, wherein said at least one cast boss includes:

an intake cast boss that receives said intake valve; and an exhaust cast boss that receives said exhaust valve.

21. The cylinder head assembly of claim 16, wherein said planar member is a stamped metal plate.

22. The cylinder head assembly of claim 16, wherein said planar member is an injection molded part.

23. The cylinder head assembly of claim 16, wherein said at least one aperture includes:

a first aperture that receives said intake valve; and a second aperture, spaced from said first aperture, that receives said exhaust valve.

24. The cylinder head assembly of claim 16, wherein said intake push rod guide includes:

a second aperture that receives said intake push rod;

a first guide member, disposed in said second aperture, that guides said intake push rod;

and wherein said exhaust push rod guide includes:

a third aperture that receives said exhaust push rod; and a second guide member disposed in said third aperture, that guides said exhaust push rod.

25. The cylinder head assembly of claim 16, wherein said planar member further comprises:

an intake spring locator that positions an intake return spring; and an exhaust spring locator that positions an exhaust return spring.

26. The cylinder head assembly of claim 16, wherein said planar member further comprises:

means for anchoring at least one rocker stud.

27. The cylinder head assembly of claim 26, wherein said anchoring means includes:

a second aperture that receives said rocker stud.

* * * * *